United States Patent [19]

Wood et al.

[11] 4,402,517

[45] Sep. 6, 1983

[54] WELL PACKER VALVE ARRANGEMENT

[75] Inventors: Edward T. Wood; Robert E. Snyder, both of Kingwood, Tex.

[73] Assignee: Completion Tool Company, Houston, Tex.

[21] Appl. No.: 408,123

[22] Filed: Aug. 13, 1982

[51] Int. Cl.[3] ..... E21B 33/12; F16J 15/46

[52] U.S. Cl. ..... 277/34; 277/31; 166/122; 166/187

[58] Field of Search ..... 277/3, 30, 31, 34, 34.3, 277/34.6; 166/120, 122, 141, 151, 166, 187, 212, 244 R

[56] References Cited

U.S. PATENT DOCUMENTS

| | | | |
|---|---|---|---|
| 3,351,349 | 11/1967 | Chenoweth | 277/34 |
| 3,373,820 | 3/1968 | Robinson et al. | 166/187 |
| 3,427,651 | 2/1969 | Billstein et al. | 166/187 X |
| 3,437,142 | 4/1969 | Conover | 277/34 X |
| 3,503,445 | 3/1970 | Cochrum et al. | 166/151 X |
| 3,542,127 | 11/1970 | Malone | 277/34 X |
| 3,581,816 | 6/1971 | Malone | 166/187 |
| 3,776,308 | 12/1973 | Malone | 166/187 |
| 3,818,922 | 6/1974 | Malone | 166/187 X |
| 4,063,427 | 12/1977 | Hoffman | 166/187 X |
| 4,260,164 | 4/1981 | Baker et al. | 277/34 |

*Primary Examiner*—Robert S. Ward, Jr.

[57] ABSTRACT

A valve system for use in inflating packers mounted on mandrels. The valve system uses one or more valves to permit, through the use of seals, the flow of fluid from the interior of a tubular mandrel to the interior of the inflatable packer when pressure applied in the mandrel exceeds at least a minimum pressure. The differential pressure across reciprocating seals is minimized through exposure of one or both sides, directly or indirectly, to the external pressure of the mandrel and packer, the exposure including the use of a check valve to permit flow from the exterior of the mandrel.

3 Claims, 4 Drawing Figures

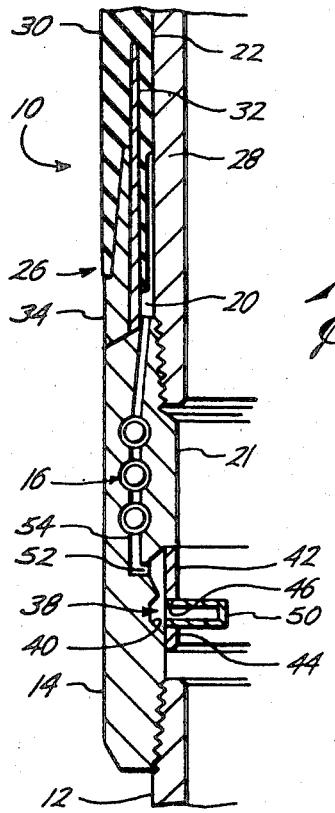
Fig. 2
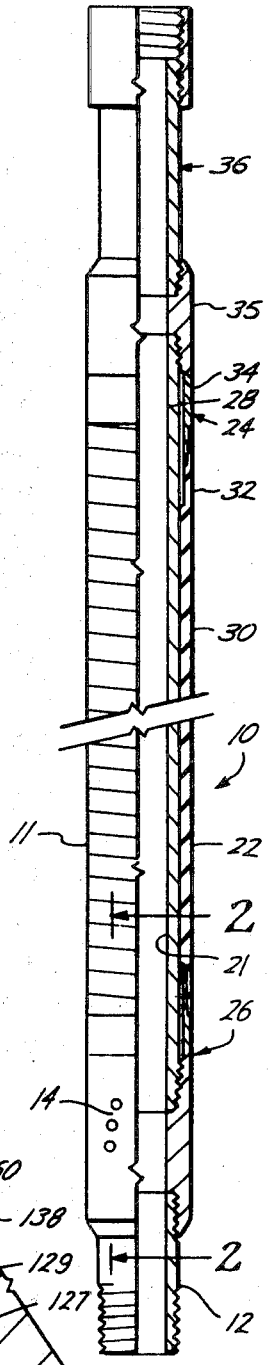
Fig. 1
Fig. 3
PRIOR ART
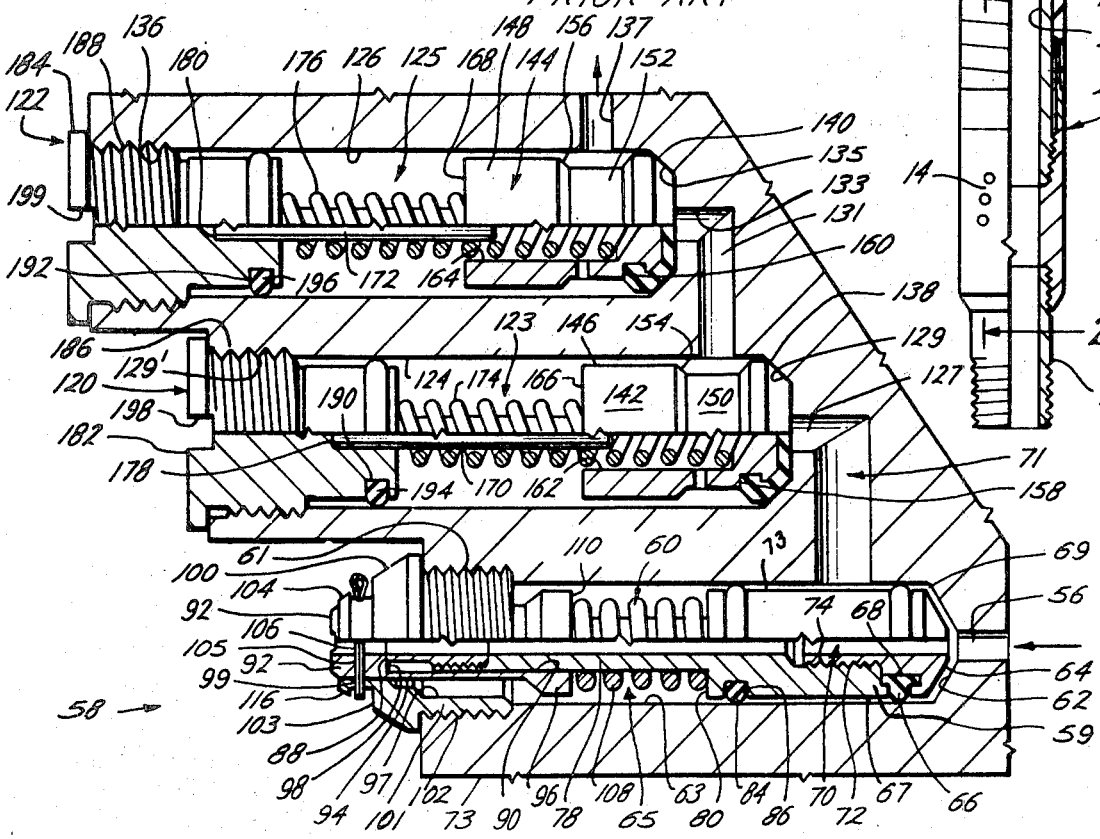

WELL PACKER VALVE ARRANGEMENT

BACKGROUND OF THE INVENTION

1. Field of the Invention

The present invention relates to packer inflation systems and more particularly to the valves which control the inflation of packers.

2. Description of the Prior Art

The control of the inflation of well packers is important to obtain integrity between the packer and the well bore for purposes of working within the bore. It is known in the art to inflate packers by various mechanisms. See, for example, U.S. Pat. No. 3,503,445, issued Mar. 31, 1970, to K. L. Cochran et al., entitled "Well Control During Drilling Operations"; U.S. Pat. No. 3,351,349, issued Nov. 7, 1967, to D. V. Chenoweth, entitled "Hydraulically Expandable Well Packer"; U.S. Pat. No. 3,373,820, issued Mar. 19, 1968, to L. H. Robinson, Jr. et al., entitled "Apparatus for Drilling with a Gaseous Drilling Fluid".

In U.S. Pat. No. 3,437,142, issued Apr. 8, 1969, to George E. Conover, entitled "Inflatable Packers for External Use on Casing and Liners and Method of Use", there is disclosed an inflatable packer for external use on tubular members such as casings, liners, and the like. A valving arrangement is disclosed therein for containing fluid within the interior of the inflatable member after it has been inflated to prevent its return to the tubular member.

Arrangements of valving have been known in the prior art to prevent further communication between the interior of the tubular member and the interior of the inflatable element after the inflatable element has been inflated and set in a well bore. See, for example, U.S. Pat. No. 3,427,651, issued Feb. 11, 1969, to W. J. Bielstein et al., entitled "Well Control"; U.S. Pat. No. 3,542,127, issued Nov. 24, 1970, to Billy C. Malone, entitled "Reinforced Inflatable Packer with Expansible Back-up Skirts for End Portions"; U.S. Pat. No. 3,581,816, issued June 1, 1971, to Billy C. Malone, entitled "Permanent Set Inflatable Element"; U.S. Pat. No. 3,818,922, issued June 25, 1974, to Billy C. Malone, entitled "Safety Valve Arrangement for Controlling Communication Between the Interior and Exterior of a Tubular Member"; and U.S. Pat. No. 3,776,308, issued Dec. 4, 1973, to Bill C. Malone, entitled "Safety Valve Arrangement for Controlling Communication Between the Interior and Exterior of a Tubular Member".

Inflatable packers have also been used in other operations, such as sealing the annular space between a jacket and a piling. See for example U.S. Pat. No. 4,063,427, issued Dec. 20, 1977, to Erwin E. Hoffman, entitled "Seal Arrangement and Flow Control Means Therefor".

The seals that are used in valves, such as in Malone, are usually hardened rubber. Such rubber tends to extrude under extreme pressure differential across the rubber and cause friction between rubber and metal that adversely affects valve operation. None of the prior art, however, provides for mechanism for equalizing pressures across the seals of the valves used to inflate packers to prevent such extrusion.

SUMMARY OF THE INVENTION

The present invention utilizes a unique arrangement of sealing mechanisms in conjunction with a valve or valves to permit the inflation of an inflatable packer element while at the same time equalizing pressure around the rubber seals of the valve or valves to prevent distortion of the seals from undue high differential pressure, and the resulting friction.

The present invention, like the prior art, is constructed and arranged so that the valve or valves remain seated to prevent communication between the interior of a tubular member and the interior of an inflatable element carried on the exterior of the tubular member until at least a predetermined pressure has been reached. This reduces the possibility of premature inflation of the inflatable element by sudden pressure changes or pressure surges which may occur within the tubular member as the tubular member is being positioned within a well bore.

However, the valve arrangement of the inflation system of the present invention includes an appropriate check valve arrangement of a portion of the valve structure to compensate for bore pressure to prevent extrusion from undue high differential pressures across the seals of certain rubber seals which must move in the valving operation.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 1 is a cross-section of a packer showing the three-valve collar for inflation of the packing;

FIG. 2 is an enlarged cross-section of the valve arrangement of FIG. 1 taken along section line 2—2 of FIG. 1;

FIG. 3 is an enlarged cross-sectional view of the three valves of a three-valve arrangement within the three-valve collar of the prior art.

DETAILED DESCRIPTION OF THE PREFERRED EMBODIMENT

Figure 4:
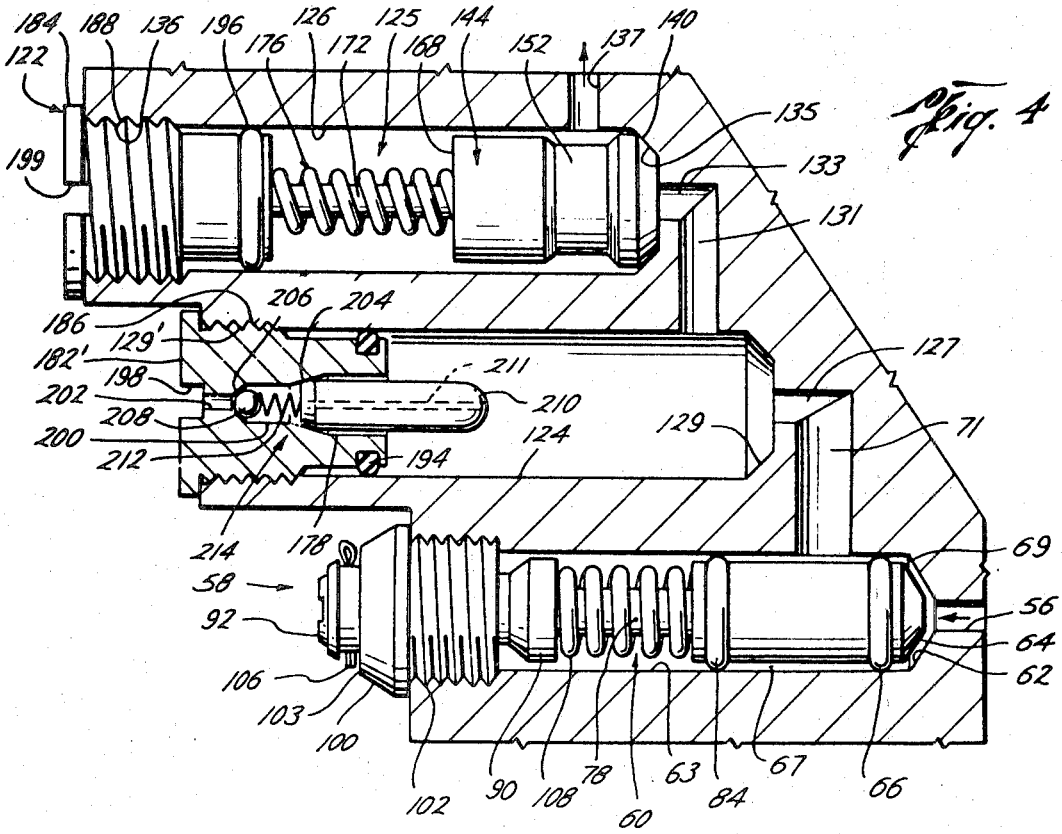
FIG. 4 is an enlarged cross-sectional view of three valves of a three-valve arrangement of the present invention within the three valve collar.

A tubular member 10 is shown in FIGS. 1 and 2. This type of member could be used for any of the embodiments of the present invention and is specifically illustrated for embodiments 1 and 2, and may be a casing packer. Member 10 includes a short casing joint or casing sub 12 for connection to other tubular members and is secured by suitable means, such as threads as illustrated in FIG. 1, to a valve collar 14 secured to the body 11 of the tubular member 10. It should be noted that the valve collar 14 could also be and is preferably secured to the sub 36 of other end of body 11 shown in FIG. 1. Valve collar 14 includes valve mechanism 16 (FIG. 2) for communicating fluid from the interior 21 of tubular member 10 to the fluid channel 20 (FIG. 2) leading to the inflatable, or packing, element 22 carried externally on tubular member 10.

The inflatable element 22 includes spaced apart annular packer heads 24, 26. Lower head 26 is secured to valve collar 14. Upper head 24 is secured to top collar 35. Inflatable element 22 extends between heads 24, 26 and is also secured to mandrel 28 which extends along the inside surface of element 22 between valve collar 14 to upper collar 35 where mandrel 28 is connected by threading or other means. The inflatable element may be of any suitable length and is provided with an elastomer cover 30 and two sets of steel anti-extrusion ribs 32. Ribs 32 are connected to the cover 30, such as, for example, vulcanized into the rubber, and extend therein. Each set of ribs 32 is connected to a steel back-up sleeve 34, and one set is connected to valve collar 14 while the other set is connected to collar 35. Sleeve 34 is also connected to packing element 22, such as vulcanized with the rubber, and to valve collar 14. A sub 36 is connected to the other portion of collar 35 for use with other tubular members.

A first set of grooves 38 is formed on valve collar 14. The set of grooves 38 includes internal, circumferential grooves 40, 42 formed in valve collar 14. Grooves 40, 42 are partially covered by juxtaposed screen sleeve 44. Sleeve 44 includes a hole 46 covered by a knock-off rod 50, usually of plastic, to isolate the valve system from pressure in the interior 21 of the member 10 during running.

Groove 42 terminates in port 52 extending partially through the wall of the valve collar 14 and connecting to passageway 54. Passageway 54 extends along the center of valve collar 14 to the port 56 of the valve system.

Shear valve 58 (FIG. 3, FIG. 4) is in fluid communication with port 56 via insertion of valve 58 in pocket 60. Pocket 60 formed in valve collar 14 by drilling of other means. Valve pocket 60 is in fluid communication with port 56. Pocket 60 forms angled valve seat 62 at the end of pocket 60 in direct fluid communication with port 56. The other end of pocket 60 is threaded with threads 61. Pocket 60 is cylindrical in shape having upper surface 63 of one diameter in upper chamber 65 and coaxial lower surface 67 of a second, smaller diameter in lower chamber 69. Upper chamber 63 has an opening to lateral passageway 71 at one end which extends further into valve collar 14.

Valve 58 includes a cylindrical shaped body 59 with an end portion 64 shaped to fit in seat 62. A T-seal, or other suitable seal, 66 is included along the circumference 73 of body 59 in groove 68 of end portion 64. Seal 66 is adapted to engage the wall 67 of the lower chamber 69 substantially parallel to the circumference 73. A threaded bore 70 having internal threads 74 is formed longitudinally along the lower portion of body 59. End 64 is connected by external threads 72, or other suitable means, to internal threads 74 of the longitudinal bore 70. The valve body 59, as illustrated, is reduced in size at the end opposite to end portion 64 to form a valve stem 78 with a first shoulder 80 formed at the juncture of valve stem 78 and the valve body 59. A suitable seal 84, such as an O-ring, is arranged in groove 86 on the upper portion of valve body 59 between the end portion 64 and shoulder 80. Seal 84 is adapted to seal against the upper surface 63 of upper chamber 65 of pocket 60 and groove 86.

Valve stem 78 terminates at its top 88 which is adjacent collet 90. Collet 90 has thick top section 92 and an elongated sleeve 94 terminating in bell-shaped lower section 96. Sections 92 and 94 form an inner end 98 which abuts stem top 88. Collet 90, which abuts valve stem 78 at its inner end 98, is retained in pocket 60 by annular retainer housing 100 which annularly surrounds collet 90. Annular retainer housing 100 has a base 101 with threads 102 formed on the outer circumference thereof. Threads 102 mate with threads 61 which secured housing 100 to pocket 60. Housing 100 further has a bore 97 formed through base 101 to receive collet 90 and an opening 116 at its top through which section 92 extends.

A shear pin 106 extends through a bore 99 in notch 103 in the end 104 of the retainer housing 100 and a bore 105 in the end 92 of collet 90 as shown in FIGS. 3 and 4 to retain valve 58 in the seated position with end portion 64 adjacent seat 62 to block off fluid flow through port 56 from the interior 18 of the tubular member 10 to the fluid channel 20 leading to the interior of the inflatable element 30 via passageway 71.

A spring 108 surrounds valve stem 78 with one end of the spring abutting the shoulder 80 and the other end abutting the end 110 of the collet 90, such spring 108 being forced to a collapsed position as illustrated when the valve is in the position as shown in FIGS. 3 and 4 of the drawings.

The strength of shear pin 106 will determine the minimum amount of fluid differential pressure necessary in port 56 to unseat the valve 58 and permit fluid flow through the port 56 from the interior of tubular member 10 to the interior of packer element 30.

Seals 66, 84 are positioned such that when the valve 58 is in the seated position as shown in FIGS. 3 and 4, the seals 66, 84 prevent any fluid flow from port 56 to passageway 71. They also prevent the flow of any fluids from the exterior of collar 14 in contact with the bore hole which leak through threads 102 and past collet 90 in housing 100 into upper chamber 65 to flow into passageway 71. In addition, when the valve 58 is in the seated position, shoulder 80 is separated from bottom 110 by a sufficient distance such that when the valve 58 is no longer in the seated position but shoulder 80 is as close to shoulder 110 as the springs will allow, seal 66 is positioned above passageway 71.

In FIG. 3, valves 120 and 122 are substantially identical in construction. Valves 120, 122 are located in pockets 123, 125 respectively. Each pocket 123, 125 is substantially cylindrical in shape with walls 124, 126 respectively formed by drilling or other suitable means of opening with one end at the exterior outer surface of valve collar 14. The other end of pocket 123 terminates at port 127 in fluid communication with the pocket 123 and passageway 71. Pocket 123 forms angled valve seats 129 at the end of pocket 123 in direct fluid communications with port 127. The other end of pocket 123 is threaded with threads 129'. Passageway 131 also formed in valve collar 14 extends laterally further into valve collar 14 from the wall of pocket 123 and is in fluid communication with pocket 123. The other end of pocket 125 terminates at port 133 in fluid communication with the pocket 125 and passageway 131. Pocket 125 forms angled valve seats 135 at the end of pocket 125 in direct fluid communications with port 133. The other end of pocket 125 is threaded with threads 136. Passageway 137 also formed in valve collar 14 extends laterally further into valve collar 14 from the wall of pocket 125 and is in fluid communication with pocket 125 and fluid channel 20.

Each of the poppet valves 120, 122 includes an end portion 138, 140 respectively of elastomer for engaging on seats 129, 135 respectively formed between ports 127, 133 and the walls of pockets 123, 125 respectively. Each valve 120, 122 has a valve body 142, 144 respectively. The general shape of each valve body 142, 144 is cylindrical in configuration. The body 142, 144 of each valve 123, 125 has an upper portion 146, 148 respectively and a lower, smaller diameter portion 150, 152 respectively with a swage 154, 156 respectively separating the upper and lower portions of valve body. The tops of elastomer ends 138, 140 are fitted into grooves 158, 160 respectively formed circumferentially in lower ends 150, 152 respectively to hold the elastomer ends on lower portions 150, 152 respectively. A bore 162, 164 is formed through the end 166, 168 respectively of valves 142, 144 facing away from seats 129, 135 and extends substantially through the valve bodies 142, 144 respectively. A valve stem 170, 172 is inserted in the bore 162, 164 respectively with a spring 174, 176 in its collapsed position circumferentially surrounding stems 170, 172 respectively.

Each valve stem 170, 172 is received in a bore 178, 180 respectively in retainer housing 182, 184 of valves 120, 122 respectively. Each retaining housing 182, 184 is externally threaded with threads 186, 188 adapted to mate with threads 129', 136 respectively of pockets 123, 125 respectively. Each housing 182, 184 also includes a slot 190, 192 sized to receive a sealing means 194, 196, such as an O-ring, to sealingly engage the walls 124, 126 of pockets 123, 125 and slots 190, 192 respectively. Each housing 182, 184 also includes a groove 198, 199 respectively cut out in the head for external access from valve collar 14.

In operation, when the rod 50 is still in place, any communication of fluid from the interior of tubular member 10 to the fluid port 56 of any of the prior art or the embodiments is prevented. This prevents pressure variations or pressure surges from acting through port 56 and unseating the valve which might prematurely inflate the element 30.

When it is desired to actuate the device of any of the embodiments and communicate fluid to the channel 20 of packing element 22 carried on the exterior of the casing or tubular member 10, any suitable means (not shown) may be dropped through member 10 so as to break or shear the rod 50 to permit fluid communication with the groove set 38.

Thereafter, fluid may be communicated through the grooves 40, 42, the port 52, and the passage 54 to the inlet port 56 between the inner and outer walls of the valve collar 14. The fluid pressure of this fluid acts upon the end portion 64 of the valve 58, and the pressure within the tubular member 10 may be increased so as to shear the pin 106 whereupon the valve body 59 moves to a position where seal 66 no longer obstructs the flow of fluid to passageway 71 from port 56 thereby permitting fluid flow from port 56 through passageway 71 to port 127. This longitudinal movement of body 59 causes the valve stem 78 as well as the collet 90 surrounding the end thereof to move outwardly through the opening 116 of the retainer housing 100, compressing spring 108 between the shoulder 80 and the end 110 of the collet 90. The flow of fluid to port 127 builds pressure on end 138. When the pressure on end 138 overcomes the break out friction of end 138 and the force to compress spring 174, valve body 142 rises so that end 138 no longer obstructs the flow of fluid from port 127 through passageway 131 to port 133. The flow of fluid to port 133 builds pressure on end 140, when the pressure on end 140 overcomes the break out friction of end 140 and the force to compress spring 176, valve body 144 rises so that end 140 no longer obstructs the flow of fluid from port 133 to passageway 137 to channel 20 and packer 30 inflates.

Those skilled in the art would believe that shear pin 106 would shear at a given pressure at port 56 depending only on the strength of the shear pin 106. However, this is not the case. At the time the tubular member 10 is lowered into the well, the pressure in passageway 71 is at atmospheric pressure. The same is true of the pressures in upper pocket chamber 65 and the pressure at port 56. However, as the tubular member 10 is lowered into the well, the pressure in upper pocket chamber 65 changes to that of the exterior of the well because there is no seal through retainer housing 100 as discussed above. In addition, as pressure within the tubular member 10 increases, the pressure at valve port 56 increases. However, there is no path for the rising pressure to enter passageway 71 and raise it above atmospheric. Accordingly, while the valve is seated, seals 66, 84 will tend to extrude toward passageway 71 because of the high differential pressure between the upper pocket chamber 65 and passageway 71, and between lower pocket chamber 69 and passageway 71. In such circumstance, the seal rings 66, 84 are locked and the pressure to overcome breakout friction to move body 59 then goes much higher. This is because the O-rings usually used in the prior art of FIG. 3 are designed to only hold 4,000 to 5,000 psi of differential pressure. In deep wells, this breakout friction would be very high and normally a discontinuity in breakout pressure is exhibited at wells having a depth which exhibit downhole pressures of 5,000 to 6,000 psi. In addition, as discussed above, the diameter of upper pocket chamber 65 is larger than lower pocket chamber 69. In the prior art, in order to overcome this difference in diameter, a sleeve is installed in upper pocket chamber 65. Nevertheless the sleeves may not be perfect and the remaining space in the upper pocket chamber 65 is elliptical in shape having a major and a minor diameter both larger than the diameter of lower pocket chamber 69. Therefore, the force of the pressure on seal 84 in upper pocket chamber 65 is greater than the force by an identical pressure acting on seal 66 from valve port 56.

Accordingly, as the well is deeper and the pressure in upper pocket chamber 65 increases, the amount of pressure required at port 56 may be far greater than anticipated by knowledge of the shear strength of shear pin 106 in order to cause shear pin 106 to shear.

To avoid the problems of the prior art of FIG. 3 the valve system is modified as shown in FIG. 4. The modifications include removal of shear valve 58 from pocket 60. In addition, valve 120 is also removed. After shear valve 58 is removed from pocket 60. All grease is removed from O-ring 84 and T-seal ring 66. The shear valve is then lubricated with Baker Tubing Seal Grease Number 499–26 which is not reactant with the O-ring seal 84 or the T-seal 66 at elevated temperatures. The shear valve 58 is then replaced in pocket 60 in the manner known in the prior art. Pocket 123 is then filled, preferably with water or other suitable substance, although it could be left unfilled.

A modified retainer housing 182' is then installed in pocket 123. The modified retainer housing 182' includes a bore 200 of smaller diameter than bore 178 drilled coaxially through bore 178. Housing 182' is further modified to include counter bore 202 coaxial with and of smaller diameter than bore 200 formed by drilling or other means through the approximate center of groove 198. The disparity of diameters causes downwardly, outwardly sloping shoulder 204 to be formed between bore 178 and bore 200 and downwardly, outwardly sloping shoulder 206 to be formed between bore 200 and bore 202. A ball 208 is located within housing 182' in close proximity to the opening of bore 202 facing bore 200. Ball 208 is held against shoulder 206 by compressed spring 212. Spring 212 is compressed by rod 210 which contains an internal longitudinal fluid passageway 211 extending therethrough and opening at each end. Rod 210 is inserted into bore 178 by hammering or other means to force the rod 210 into the entry of bore 200 where it is held by friction with spring 212 and ball 208 extending into cocurrent bore 200 such that ball 208 abuts the shoulder 206 and the rod 210 extends substantially into the shoulder 204 forming a check valve assembly 214.

In operation, the member 10 of the first embodiment of FIG. 4, when lowered into the bore hole, will cause the pressure in passageway 71 to be approximately the same as the pressure in upper pocket chamber 65 of bore 60. This is effected by the check valve assembly 214. As pressure from the bore hole acts on tubular member 10, and particularly on modified housing 182', fluid will flow from counter bore 202 through bore 200 to bore 178, around ball 208, through passageway 211 in hollow rod 210 and thence to pocket 123, port 127 and passageway 71. This will permit the fluid in pocket 123 to be maintained at the pressure approximately that surrounding the tubular member 10 which is substantially the pressure in the upper pocket chamber 65. Accordingly, the differential pressure between upper pocket chamber 65 and passageway 71 across seal 84 will be very small. Further, the pressure at port 56 will also initially be approximately that of the bore so that the differential pressure across seal 66 will be very small. In addition, as the pressure in port 56 increases, and pin 106 shears, causing body 59 to move such that seal 66 moves to a position longitudinally above passageway 71, the pressure in pocket 123 will increase causing ball 208 to seat on the shoulder 206 thereby stopping further fluid communication between bore 200 and bore 202. Therefore, the pressure in passageway 71 will continue to rise causing valve 122 to unseat and permitting fluid flow to passageway 137.

The modified port plug 182' is usually covered with Shell Darina Grease Number 2 or other suitable lubricant to prevent plugging of the check valve 214.

In addition, because multiple packers are usually run along a tubular string comprised of tubular members 10 and other tubular members, the seal diameters should be measured and an indication of such be made, such as on the valve collar 14. In this manner the packer with the smallest upper seal 84 area will be run closest to the bottom of the hole to minimize distortion caused by different areas between seals 84 and 66 since the devices of the prior art always have a larger area for seal 84 than for seal 66.

Although the system described in detail above is most satisfactory and preferred, many variations in structure and method are possible.

Because many varying and different embodiments may be made within the scope of the inventive concept herein taught and because modifications may be made in accordance with the descriptive requirements of the law, it should be understood that the details herein are to be interpreted as illustrative and not in a limiting sense.

What is claimed as invention is:

1. A tubular system for use in packing off a well bore, comprising:

a hollow tubular mandrel;

a packer attached to said mandrel at one end of said mandrel;

a valve collar mounted on the other end of said mandrel, the other end of said packer being attached to said collar and having a passageway therethrough, and said collar being in fluid communication with said packer and the interior and exterior of said mandrel by said passageway;

said passageway having enlarged portions in said collar;

a valve system mounted in said enlarged portions, said valve system including three valves;

the first of said valves being mounted in the first of said portions and having a reciprocating member and a stop means for preventing reciprocation of said reciprocating member prior to the application of at least a predetermined difference in pressure between one side of said reciprocating member and the other side, said reciprocating member being located at one end of a first part of said passageway when said stop means prevents reciprocation and having at least two seals thereon for preventing the flow of fluid from either end of said reciprocating member around the member to said first passageway part;

said first valve being in fluid communication with a second part of said passageway in fluid communication with said interior of said mandrel on one side of said reciprocating member;

said first valve being in fluid communication with said exterior of said mandrel on the other side of said reciprocating member; and the second of said valves having check means for permitting the flow of fluid from said exterior of said mandrel to said first part of said passageway when the pressure exterior of said mandrel exceeds the pressure in said second portion;

said second portion includes a first bore opening to said exterior of said mandrel and said second valve is located in said first bore;

said second valve includes a head adapted to connect to said first bore, a seal mounted on said head and sealingly engaging the walls of said first bore and said head, and said check means is mounted in said head;

said check means includes a second bore through said head and substantially coaxial with said first bore;

a third bore through a portion of said head substantially coaxial with said first and second bores, said third bore being of a greater diameter than said second bore and forming a shoulder therewith;

a ball adapted to seal against said shoulder; and mounting means for reciprocably mounting said ball in said third bore.

2. The system of claim 1 wherein said mounting means includes:

a rod, said rod being wedged into an end of said third bore;

a spring, said spring being mounted in said third bore and abutting said ball and one end of said rod.

3. The system of claim 2 wherein said rod has a hollow longitudinal fluid passage therethrough.

* * * * *